United States Patent [19]

Otsuka

[11] 4,072,430

[45] Feb. 7, 1978

[54] WRITING INSTRUMENT

[75] Inventor: Katsumi Otsuka, Funabashi, Japan

[73] Assignee: Teibow Company Limited, Japan

[21] Appl. No.: 602,402

[22] Filed: Aug. 6, 1975

[30] Foreign Application Priority Data

Sept. 6, 1974 Japan ..... 49-107271[U]

[51] Int. Cl.[2] ..... B43K 1/06

[52] U.S. Cl. ..... 401/265; 401/292

[58] Field of Search ..... 401/198, 199, 282, 292

[56] References Cited

U.S. PATENT DOCUMENTS

| | | | |
|---|---|---|---|
| 3,203,025 | 8/1965 | Schreur | 401/198 X |
| 3,361,516 | 1/1968 | Rigondaud | 401/292 |
| 3,464,775 | 9/1969 | Beal | 401/199 |
| 3,932,044 | 1/1976 | Otake et al. | 401/265 |
| 3,945,869 | 3/1976 | Miller | 401/198 |

*Primary Examiner*—Stephen C. Pellegrino

*Attorney, Agent, or Firm*—Irving M. Weiner; Pamela S. Austin

[57] ABSTRACT

An improved writing nib for a writing instrument comprising a casing and an ink reservoir in the casing. The nib comprises an outer cylindrical wall and equiangularly spaced inner partitions which are formed integral with the wall in cantilever fashion. Each inner partition has a transverse cross section which is comprised of a plurality of partially intersected circles of different diameter.

11 Claims, 5 Drawing Figures

WRITING INSTRUMENT

The present invention relates to a writing instrument provided with an improved writing nib of synthetic resin materials.

There is a general demand for a writing nib which has a smooth introduction of ink from an ink reservoir to the nib in order to avoid such problems as scratching during writing.

A principal object of the present invention is to provide a writing instrument which satisfies the abovementioned demand.

Another object of the invention is to provide a writing instrument provided with an improved writing nib which has a superior capillary action and allows the smooth introduction of ink from the ink reservoir to the tip of the nib.

A further object of the invention is to provide a writing instrument which can utilize many types of inks of various physical properties.

A still further object of the invention is to provide a writing instrument provided with an improved writing nib which has a flexible structure.

The writing instrument of the present invention comprises a cylindrical casing having a rear end and a forward end, an ink reservoir in said casing, and a writing nib having a rear end in the ink reservoir and a forward end projecting from the forward end of said casing. The nib has a tapered tip portion extending forwardly from the forward end of the casing. The improvement of the present invention resides in the fact that the nib comprises an outer wall of cylindrical shape and a plurality of inner partitions formed integral with said outer wall in cantilever fashion. Each inner partition has a transverse cross section which is comprised of a plurality of partially intersected circles of different diameter, so that an inner capillary conduit for ink comprised of a plurality of capillary passages of various transverse dimensions is defined between the outer cylindrical wall and the inner partitions. One end of the inner capillary conduit for the ink terminates at the tapered tip portion of the nib and the other end terminates at the rear end of the nib. Consequently, the ink contained in the ink reservoir is introduced from the reservoir to the inner capillary conduit and can flow to the tip portion through the capillary passages of various dimensions. As a result the ink flows smoothly and continuously to the tip through the capillary passage upon the consumption of ink due to the use of the writing instrument. Preferably, the outer cylindrical wall has an outer portion and inner portion formed integral with the outer portion. The outer portion has a transverse cross-section which is comprised of a plurality of partially intersected first circles. The inner portion has a transverse cross-section which is comprised of a plurality of partially intersected second circles. Each first circles is partially intersected with respective second circles at the side thereof. The diameter of the second circles is smaller than that of the first circles, so that equiangularly spaced outer capillary conduits are formed between the inner portion and the outer portion along the longitudinal direction of the nib. One end of the outer capillary conduits for the ink terminates at the tapered tip portion of the nib and the other end terminates at the rear end portion of the nib and, as a result, the ink contained in the ink reservoir is additionally introduced in the nib through the outer capillary conduits.

Further features and advantages of the present invention will be more apparent from the following description, reference being made to the accompanying drawings in which.

Figure 1:
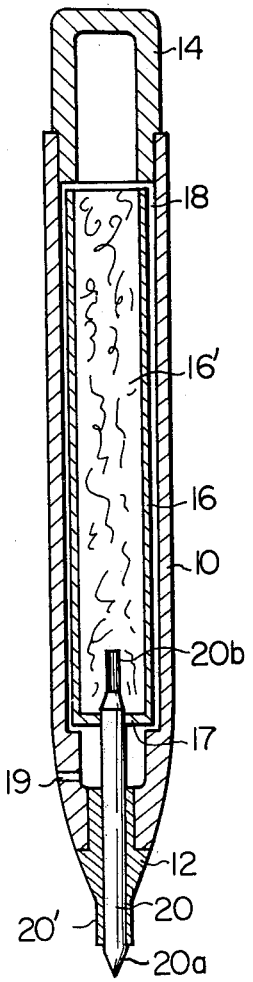
FIG. 1 is a side cross-sectional view of the writing instrument of the present invention.

Referring to FIG. 1, the writing instrument of the present invention has a cylindrical casing 10 having a rear end and forward end. A nib holder 12 is fixedly mounted to the forward end of the casing 10 and a cap 14 is detachably push-mounted to the rear end of the casing 10. An ink reservoir 16, which is replaceable, is housed in a space 18 which is defined by the interior of the casing 10. A vent hole 19 which allows atmospheric pressure to enter the space 18 is provided in the wall of the casing 10 adjacent to the nib holder 12. The ink reservoir 16 includes a cylindrical fibrous block 16', in which ink is reserved. The ink reservoir 16 is inserted into the cylindrical casing 10 through a rear end aperture of the casing 10. After completion of the insertion of the ink reservoir 16, the cap 14 is attached to the rear end of the casing 10.

A writing nib 20 according to the invention is fixedly mounted to the nib holder 12. The rear end **20*b* of the writing nib 20 is inserted into an end wall 17 of the ink reservoir 16, and extends into the interior space of the reservoir 16 so as to introduce ink contained in the fibrous block 16' into the nib 20. The forward end 20*a* of the nib 20 extends out of the forward portion 20' of the nib holder 12. The nib 20** is made of a certain thermoplastic synthetic resin, and has an improved construction as will be described hereinafter.

Referring to FIGS. 2 through 5, the writing nib 20 according to the invention has an outer wall 22 of cylindrical shape. The outer wall 22 has an outer cylindrical portion and an inner cylindrical portion. As shown particularly in FIG. 5, the outer portion of the wall 22 has a transverse cross-section which is comprised of a plurality of partially intersected circles 24. The inner portion of the wall 22 has a transverse cross-section which is comprised of a plurality of partially intersected other circles 26. Each circle 26 is partially intersected with the respective circles 24. The diameter of each circle 24 is larger than that of each circle 26. As a result of this arrangement equiangularly displaced capillary passages 28 for the ink are formed in the outer wall 22 along the longitudinal direction thereof. At the same time equiangularly spaced recesses 25 for the ink are formed on the outer surface of the wall 22 along the longitudinal direction thereof.

The writing nib 20 of the invention also has a plurality of inner partitions 30, 32 and 34 which are equiangularly spaced and which are formed integral with the outer wall 22 in a cantilever fashion.

Figure 3:
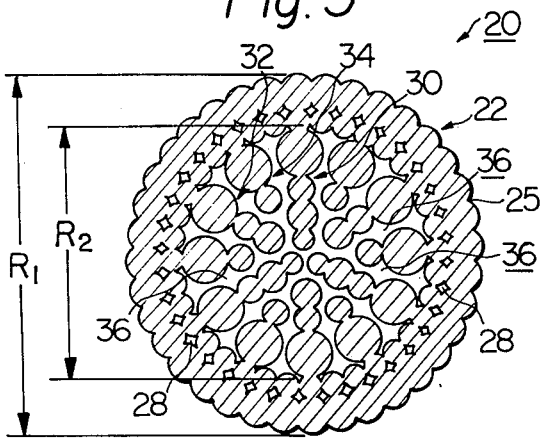
FIG. 3 is a cross-sectional view of the writing nib of the present invention taken along line III—III in FIG. 2.
Figure 4:
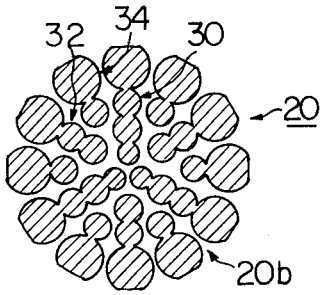
FIG. 4 is a cross-sectional view taken along line IV—IV in FIG. 2.
Figure 5:
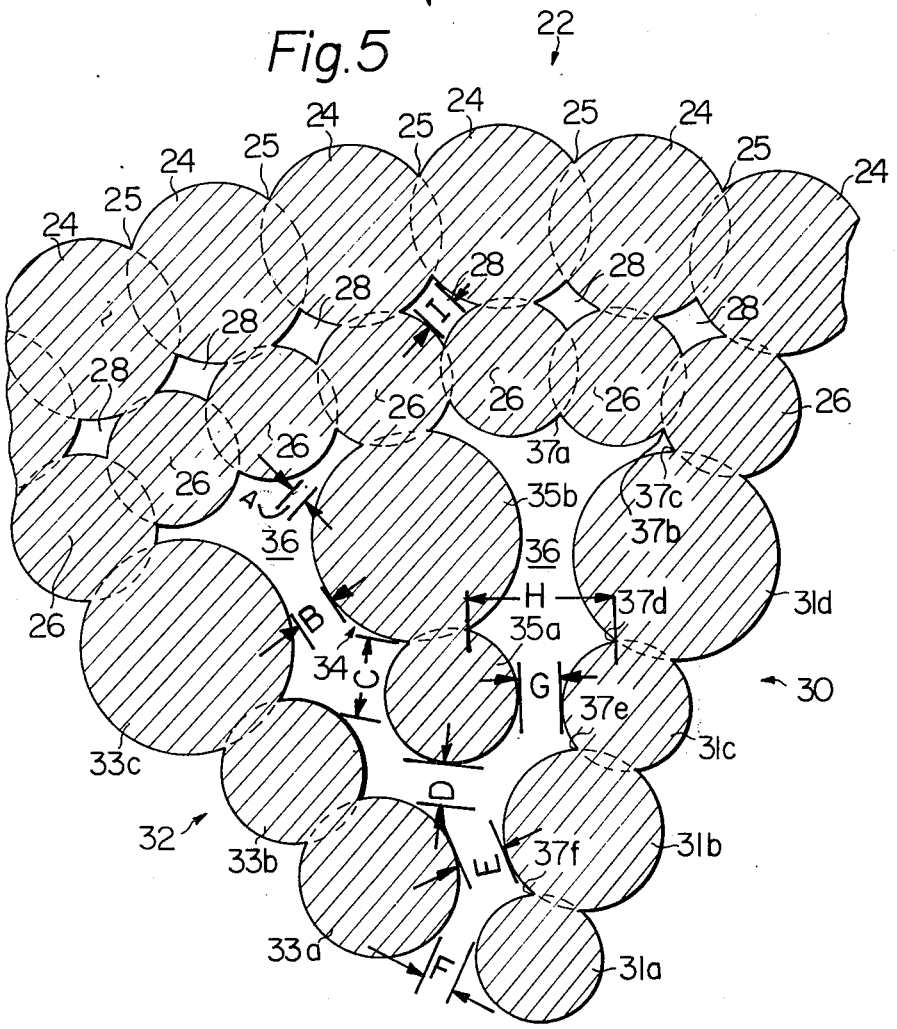
FIG. 5 is a enlarged partial view of FIG. 3.

In this embodiment the longest inner partitions 30, of which there are three, are arranged at an angle of 120° to each other along the longitudinal direction of the nib 20. As shown in FIGS. 3 and 5, the transverse cross-section of each wall 30 is comprised of a plurality of partially intersected circles **31*a*, *b*, *c* and *d* of different diameter. Each inner most circle 31***a* is situated in a position near the center axis of the nib 20. Each outermost circle 31*d* is partially intersected with the respective circle 26. In this embodiment the partitions 32, of which there are three, are arranged at an angle of 120° to each other.

As shown in FIG. 5, the transverse cross-section of each partition 32 is comprised of a plurality of partially intersected circles 33*a, b* and *c* of different diameter. Each outer most circle 33*c* is partially intersected with the respective circle 26. In this embodiment, each of the shortest partitions 34, of which there are six, is arranged between an adjacent longest partition 30 and middle length partition 32. As shown in FIG. 5, the transverse cross-section of each wall 34 is comprised of partially intersected circles 35*a* and *b* of different diameter. Each outer most circle 35*b* is partially intersected with the respective circle 26.

As a result of the above-mentioned arrangement of the inner partitions 30, 32 and 34 and outer wall 22, a inner capillary conduit for ink comprised of a plurality of capillary passages 36 are defined between the outer cylindrical wall 22 and the inner partitions 30, 32 and 34. Each of the passages 36 includes a plurality of recesses (for example, 37*a, b . . . f,* etc) which are formed on the surface of the outer wall 22 and inner partitions 30, 32 and 34 along the longitudinal direction of the nib 20.

Figure 2:
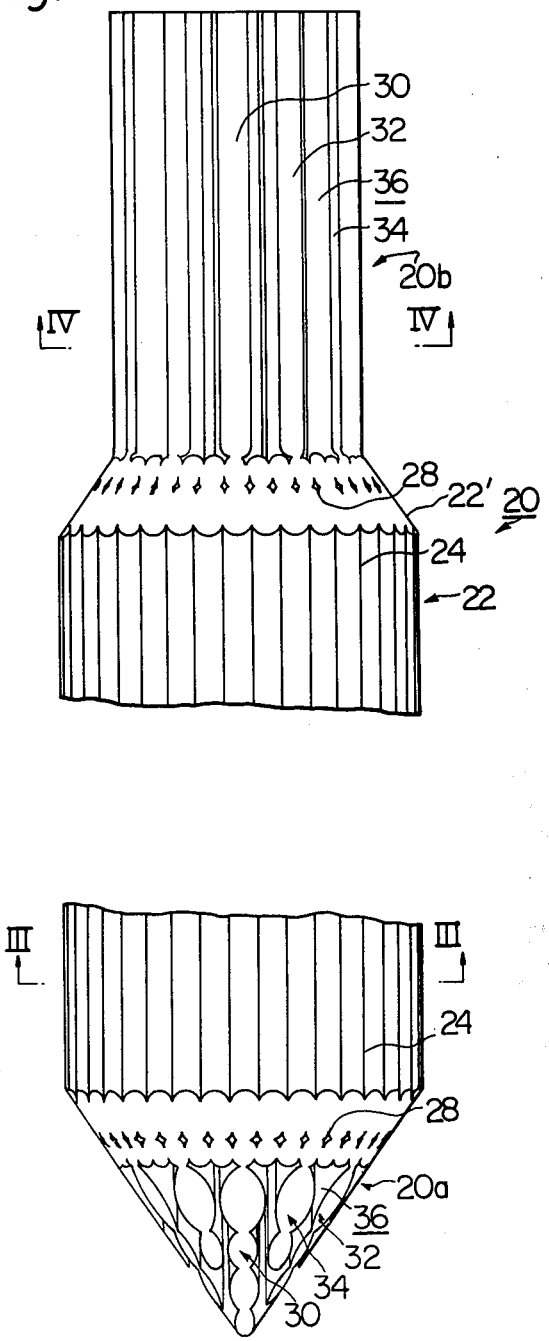
FIG. 2 is an enlarged side elevational view of the writing nib of the present invention.

As shown in FIG. 2, a tip portion 20*a* of the nib 20 is formed into a conical shape with a sharp point, which, for example, can be obtained by a grinding operation. Therefore, the capillary passages 28 in the outer wall 22 and the capillary passages 36, which are defined by the inner partitions 30, 32 and 34, terminate at the outside surface of the tip portion 20*a* of the nib 20.

As shown in FIG. 2, the outer wall 22 terminates at a distance from the rear end of the nib 20 so as to form a frustoconical shape, which can be obtained by a grinding operation. Therefore, in the rear end portion 20*b* of the nib 20, the capillary passages 28 terminate at the surface of the frustoconical portion 22', and the capillary passages 36 are opened along the longitudinal direction of the nib 20, so that introduction of the ink from the ink reservoir 16 is eased.

As shown in FIG. 1, the rear end 20*b* of the nib 20 is engaged with the fibrous block 16', in which ink is reserved, while the tip portion 20*a* of the nib extends out of the nib holder 12 for writing.

In the use of the writing instrument according to the present invention, the ink in the ink reservoir 16 is smoothly and continuously introduced throughout the writing operation. This is because, in comparison with the known art, a number of capillary passages for the ink are provided by the above-mentioned arrangement of the outer wall 22 and inner partitions 30, 32 and 34. The ink introduced by the capillary action though the rear end portion 20*b* flows not only through the inner capillary passages 36 but also through the circumferential capillary passages 28. At the same time the longitudinal recesses 25, 37*a . . . f,* etc., on the surface of the outer wall 22 and inner partitions 30, 32 and 34 serve as passages for the ink. In other words, a large quantity of the ink can flow through the nib 20 in comparison with the prior art. Therefore a uniform supply of the ink is attained and, thus, no problem such as scratching is noticed.

In the present invention the inner capillary passages 36 have a plurality of longitudinal recesses 37*a . . . f,* etc., so that the capillary passages 36 have various widths in the transverse direction. As a result of this, the capillary action of the nib 20 according to the invention is very strong. Therefore, many types of inks of various physical properties (such as the surface tension of the ink, or the viscosities of the inks) can be utilized without problems such as "drain back" of the ink from the nib 20 to the ink reservoir 16 when the writing instrument is held upright for a long time. In addition to the above-mentioned advantages, the nib of the invention has a more flexible structure because of the coreless structure of the nib. This coreless structure is attained by the provision of the outer cylindrical wall 22 and the inner partitions 30, 32 and 34 connected therewith.

The dimensions of the nib components are shown in exaggerated and greatly amplified scale to facilitate an understanding of the construction. This will be appreciated from the dimensions in the following examples of the diameters of the various circles and the widths of various portions of the capillary passages.

| | Example 1 | Example 2 |
|---|---|---|
| Diameters of the various circles | | |
| $R_1$ | 0.812 mm | 1.107 mm |
| $R_2$ | 0.5744 | 0.7836 |
| 24 | 0.0896 | 0.1074 |
| 26 | 0.062 | 0.083 |
| 31a | 0.054 | 0.112 |
| 31b | 0.0816 | 0.1156 |
| 31c | 0.0824 | 0.1094 |
| 31d | 0.1180 | 0.1670 |
| 33a | 0.0764 | 0.1010 |
| 33b | 0.0780 | 0.1046 |
| 33c | 0.1176 | 0.1596 |
| 35a | 0.0756 | 0.1016 |
| 35b | 0.1180 | 0.163 |
| Widths of various portions of capillary passage | | |
| A | 0.0054 | 0.0054 |
| B | 0.0056 | 0.0194 |
| C | 0.00346 | 0.0506 |
| D | 0.00130 | 0.0260 |
| E | 0.0250 | 0.0410 |
| F | 0.00274 | 0.0306 |
| G | 0.0096 | 0.022 |
| H | 0.0354 | 0.0550 |
| I | 0.008 | 0.0086 |

The above described characteristic construction of the writing instrument of the present invention is not limited to the above-mentioned disclosure and drawings, and any modification thereof having the same function may be considered as being within the scope of the present invention.

What is claimed is:

1. In a writing instrument comprising a cylindrical casing having a rear end and a forward end, an ink reservoir in said casing, and a writing nib having a rear end in said ink reservoir and a forward end projecting from the forward end of said casing, said nib having a tapered tip portion extending forwardly from said forward end of the casing, the improvement wherein said nib comprises an outer wall of cylindrical shape and a plurality of inner partitions formed integral with said outer wall in cantilever fashion, each said inner partition having a transverse cross-section which is comprised of a plurality of partially intersected circles of different diameter aligned radially in such a manner that the intersected circles of larger diameter and of smaller diameter are arranged alternately, each intersected circle of each inner partition being spaced circumferentially on a concentric circle coaxial with said outer cylindrical wall from the corresponding intersected circle having the same diameter of the neighboring inner partition, so that an inner capillary conduit for ink comprised of a plurality of capillary passages of various transverse dimensions is defined between said outer cylindrical wall and said inner partitions, one end of said inner capillary conduit for the ink terminating at said tapered tip portion of the nib and the other end terminating at said rear end of the nib, whereby said ink contained in said ink reservoir is introduced from said reservoir to said inner capillary conduit and can flow to said tip portion through said capillary passages of various dimensions, so that the ink flows smoothly and continuously to said tip through the capillary conduit upon the consumption of ink due to the use of said writing instrument.

2. An improved writing instrument according to claim 1, wherein said outer cylindrical wall (22) has an outer cylindrical portion and inner cylindrical portion formed integral with said outer portion, said outer portion having a transverse cross-section which is comprised of a plurality of partially intersected first circles (24), said inner portion having a transverse cross-section which is comprised of a plurality of partially intersected second circles (26), each said second circle (26) being partially intersected with respective first circles (24), the diameter of said second circles (26) being smaller than that of said first circles (24), so that equiangularly spaced outer capillary conduits (28) are formed between said inner portion and said outer portion along the longitudinal direction of said nib (20), one end of said outer capillary conduits (28) for the ink terminating at said tapered tip portion **(20*a*) of said nib (20) and the other end of said outer capillary conduits (28) terminating at said rear end portion (20*b*) of said nib (20), whereby said ink contained in said ink reservoir (16) is additionally introduced in said nib (20) through said outer capillary conduits (28)**.

3. An improved writing instrument according to claim 1, wherein three groups of inner partitions are provided equiangularly spaced, three longest partitions being arranged 120° to each other, three middle length partitions being arranged 120° to each other and six shortest partitions being arranged between adjacent longest and middle length partitions.

4. A writing instrument according to claim 2, wherein said nib is made of plastic materials.

5. In a writing instrument comprising a cylindrical casing (10) having a rear end and a forward end, an ink reservoir (16) in said casing (10), and a writing nib (20) having a rear end **(20*b*) in said ink reservoir (16) and a forward end (20*a*) projecting from the forward end of said casing (10), said nib (20) having a tapered tip portion (20*a*) extending forwardly from said forward end of the casing (10), wherein the improvement comprises said nib (20)** having:

an outer wall (22) of cylindrical shape and a plurality of inner partitions (32, 32, 34) formed integral with said outer wall (22) in cantilever fashion;

each said inner partition (30, 32, 34) having a transverse cross-section which is comprised of a plurality of partially intersected circles of different diameter aligned radially;

each intersected circle of each inner partition (30, 32, 34) being spaced circumferentially on a concentric circle coaxial with said outer cylindrical wall (22) from the corresponding intersected circle having the same diameter of the neighboring inner partition, so that an inner capillary conduit for ink comprised of a plurality of radial capillary passages (36) of substantially varying width along a radial direction is defined between said outer cylindrical wall (22) and said inner partition (30, 32, 34);

each intersected circle of each partition and the corresponding intersected circle of the neighboring partition defining a constricted capillary passage zone; and two adjacent intersected circles of each partition and the corresponding two intersected circles of the neighboring partition defining an enlarged capillary passage zone.

6. A writing instrument according to claim 5, wherein said partitions (30, 32, 34) have three different lengths along a radial direction, the segment of the shortest length (34) being positioned between the segment of the longest length (30) and the segment of the middle length (32).

7. A writing instrument according to claim 6, wherein three of the longest length partitions (30), three of the middle length partitions (32), and six of the smallest length partitions (34) are provided so as to be equiangularly spaced from each other.

8. A writing instrument according to claim 5, wherein:

said outer cylindrical wall (22) has an outer cylindrical portion and inner cylindrical portion formed integral with said outer portion;

said outer portion having a transverse cross-section which is comprised of a plurality of partially intersected first circles (24), said inner portion having a transverse cross-section which is comprised of a plurality of partially intersected second circles (26);

each said second circle (26) being partially intersected with respective first circles (24) the diameter of said second circles (26) being smaller than that of said first circles (24), to form equiangularly spaced outer capillary conduits (28) formed between said inner portion and said outer portion along the longitudinal direction of said nib (20);

one end of said outer capillary conduits (28) for the ink terminating at said tapered tip portion **(20*a*) of said nib (20); and the other end of said outer capillary conduits (28) terminating at said rear end portion (20*b*) of said nib (20) so that said ink contained in said ink reservoir (16) is additionally introduced in said nib (20) through said outer capillary conduits (28)**.

9. A writing instrument according to claim 5, wherein:

three groups of said inner partitions (30, 32, 34) are provided equiangularly spaced;

three longest partitions (30) being arranged 120° to each other; and three middle length partitions (32) being arranged 120° to each other; and six shortest partitions (34) being arranged between adjacent longest and middle length partitions (30 and 32).

10. A writing instrument according to claim 8, wherein said nib (20) is made of plastic materials.

11. A writing instrument, comprising:

a casing;

an ink reservoir in said casing;

a writing nib having a first end extending to said ink reservoir, and having a second end extending out of said casing;

said nib includes an outer wall and inner partitions secured to said outer wall in cantilever fashion;

each said inner partition has a transverse cross-section formed completely by intersecting circles;

an inner capillary passage zone formed by the continuous and contiguous space disposed between said inner partitions;

an outer capillary passage zone surrounding but separated from said inner capillary passage zone; and said outer capillary passage zone comprising a plurality of separate, distinct and disconnected outer capillary conduits (28) formed in said outer wall of said writing nib.

* * * * *